US006206109B1

(12) United States Patent
Monier et al.

(10) Patent No.: US 6,206,109 B1
(45) Date of Patent: Mar. 27, 2001

(54) APPARATUS AND METHOD FOR PILOT-TUBE GUIDED AUGER BORING

(75) Inventors: David J. Monier; Francis E. Robinson, both of Perryville, MO (US)

(73) Assignee: Exactgrade Underground Infrastructute, LLC

( * ) Notice: Subject to any disclaimer, the term of this patent is extended or adjusted under 35 U.S.C. 154(b) by 0 days.

(21) Appl. No.: 09/204,751

(22) Filed: Dec. 2, 1998

(51) Int. Cl.[7] ..... E21B 5/06
(52) U.S. Cl. ..... 175/53; 175/62
(58) Field of Search ..... 175/53, 62, 406, 175/391, 390, 19; 405/154, 158

(56) References Cited

U.S. PATENT DOCUMENTS

| | | | | |
|---|---|---|---|---|
| 2,839,281 | * | 6/1958 | Kandle | 175/53 |
| 3,469,638 | * | 9/1969 | Atkins | 175/53 |
| 3,554,303 | * | 1/1971 | Zajkowski | 175/19 |
| 4,020,641 | * | 5/1977 | Takada | 405/184 |
| 4,024,721 | * | 5/1977 | Takada et al. | 405/184 |
| 4,486,124 | * | 12/1984 | Yamamuro et al. | 405/184 |

* cited by examiner

*Primary Examiner*—Robert E. Pezzuto
*Assistant Examiner*—Meredith C. Petravick

(74) *Attorney, Agent, or Firm*—Lathrop & Gage L.C.

(57) ABSTRACT

An apparatus and method for trenchless, underground emplacement of man-sized product pipe between first and second shaft locations is disclosed. The apparatus comprises a pilot tube assembly having a pilot tube segment and a steering head mounted to the pilot tube segment. The steering head is configured to operatively guide the pilot tube assembly from the first shaft location to the second shaft location. The apparatus further comprises an intermediate sleeve assembly having an intermediate sleeve segment and an intermediate cutting head mountable to the pilot tube assembly and to the sleeve segment. The intermediate cutting head has a diameter substantially greater than the diameter of the pilot tube assembly and is configured to be operably guided by the pilot tube assembly. An enlarging assembly of the apparatus comprises a drive sleeve segment and an enlarging cutting head mounted to the intermediate sleeve assembly and to the drive sleeve segment. The enlarging cutting head has a diameter substantially larger than the diameter of the intermediate sleeve assembly and the drive sleeve segment. The enlarging cutting head and the drive sleeve segment are operably guidable by the intermediate sleeve assembly. A drive assembly successively advances the pilot tube assembly, the intermediate sleeve assembly, the trailing assembly, and product pipe from the first shaft location to the second shaft location.

8 Claims, 4 Drawing Sheets

APPARATUS AND METHOD FOR PILOT-TUBE GUIDED AUGER BORING

BACKGROUND OF THE INVENTION

1. Field of the Invention

This invention relates generally to an apparatus and method for underground pipe installation and, more particularly to an apparatus and method for trenchless installation of product pipe through pilot-tube guided, auger boring.

2. Discussion of Related Art

Various applications require the installation of underground pipe between two stations without creating a trench therebetween, such as between two manholes. Techniques have been developed to accomplish such trenchless installation of pipe. Most of these methods are based on pipe-jacking principles, that is, protective pipes or product pipes are jacked through the ground by means of a hydraulically operated jacking unit from a previously prepared starting or jacking shaft to a target shaft. For example, one method for installing product pipes of non-man-sized nominal diameters in such an environment is shown and described in U.S. Pat. No. 4,630,967 and DE-GmS No. 82-05-543, the teachings of which are incorporated herein by reference.

Microtunneling involves horizontal jacking systems directly installing product pipe by jacking the pipe to a predetermined line and level. This technique for the trenchless construction of service tunnels is accurate for non-man size nominal inside diameter pipe and is accurate for drive lengths of about 1000 linear feet. Tunnel boring techniques install product pipe by jacking pipe into a bore created by a cutting head. This method is used for pipes with man-size nominal inside diameter (e.g., 36 in. and larger) and is accurate for drive lengths of approximately 2000 linear feet. Both microtunneling and tunnel boring techniques typically employ laser steering. For large diameter pipes (up to 72 in. internal diameter), auger boring techniques using a horizontal earth boring machine can be used for short drives up to approximately 300 linear feet. The line and grade control systems for auger boring, however, is not very precise.

To reduce the load encountered by the product pipe in these techniques and to thereby drive greater lengths, a two-pass system may be employed. In this system, a temporary steel liner is installed initially into the bore to the predetermined line and level. After the bore is completed, product pipe is jacked into the bore replacing the temporary pipe. Two-pass systems allow greater load, reduce damage to the permanent pipe and achieve longer drives. But, these advantages may be offset due the additional time required for operation.

The pilot-bore method of microtunneling overcomes this concern by employing a three-pass system. In the first stage shown in FIG. 1, precision on-target jacking of pilot pipes displaces the soil by consolidation to create a bore. This method is particularly designed for softer soils where consolidation is possible without creating problems associated with soil movement. Suitable soils are cohesive soils, such as clays and silts with N values up to 60, as well as sands.

The pilot pipes are kept on-line through a steering mechanism including a theodolite fitted with a camera and an illuminated target displayed on a monitor, which is viewed from the jacking shaft. Any deviation from the reference axis is correctable through counter steering of the pilot-pipe assembly.

After the pilot pipe has been installed in the length required and has entered the target shaft, a second stage of the pilot-bore method widens the bore to a specified diameter by means of an expanding head, as shown in FIG. 2. The expanding head has a diameter greater than the pilot pipes' diameter and is fitted on both a first segment of a steel sleeve assembly and attached to the last section of pilot pipe in the jacking shaft. A driving unit advances the first steel sleeve segment and expanding head through the pilot-pipe created bore, with the pilot-pipe assembly serving as guidance to maintain the required line and level. Additional steel sleeve segments are advanced one behind the other into the drive unit to urge the pilot tube from the newly created bore segment by segment. The expanding head is typically an excavating type whereby spoil may be removed internally of the sleeves As the expanding head is advanced and cuts the soil to the required diameter, an auger chain positioned within the steel sleeves removes the displaced soil to a discharge positioned in the jacking station.

As the expanding head enters the target shaft, the third stage of the pilot-bore method shown in FIG. 3 involves placing product pipe into the drive unit and jacking it into the bore one segment behind the other to advance the steel sleeves of the second stage through to the target shaft. As such, product pipe is placed in the desired position without disturbing the surface of the earth between the jacking station and target station. The pilot pipe and steel sleeves are recovered segment by segment and ready to use for the next installation.

Pilot-bore microtunnelling methods have been used to install product pipes of various kinds with internal diameters in the range from 150 mm to 450 mm.

A problem with the pilot-bore microtunnelling method is that it is limited in the maximum diameter of pipe installable (to approximately 575 mm.). For most soil types and conditions, the maximum outer diameter of the expanding head, which determines the maximum diameter of the permanent piping that follows the expanding assembly is about 22½ in. As the diameter of the expanding head begins to exceed this diameter, the pilot tube, which advances through the soil by consolidation to create a bore having walls formed of compacted soil, looses its ability to steer the trailing expanding head along a desired line and grade to the intended target. When the expanding head diameter is about 22½ in., the compacted soil walls of the bore hole possess sufficient strength to resist a deflection of the pilot tube passing through the bore hole, which deflection would otherwise be caused by uneven forces imposed on the leading edge of the expanding head as it encounters and advances through varying soil types and conditions. If the pilot tube deflects from the desired line and grade as it is pushed through the bore hole by the expanding head, then the expanding head, and more importantly, the permanent piping following behind the expanding head, will be steered off course.

The maximum diameter of the expanding head for successful use in trenchless tunneling is, therefore, a function of strength of the pilot bore hole walls, which in turn is effected by the degree of compaction caused by the pilot tube as it is initially advanced through the soil. That is, pilot tubes having larger diameters will create a higher degree of soil compaction, and thus greater wall strength, as the pilot tube advances through the soil. Soil type and soil condition will also effect the degree of soil compaction.

The resistance to deflection is further dependent on the circumferential contact area of the pilot tube. Thus, pilot tubes having a diameter greater than 4½ in. would permit the expanding head to have a diameter larger than about 22½ inches. Pilot tubes larger than 4½ in. are typically not installed by consolidation because of potential damage to surrounding structures and utilities due to soil movement during the installation process. Experience has shown that pilot tube assemblies with pilot tubes having about 4½ in. diameters provide optimal results for typical soil and work conditions.

In some applications, capacity requirements between two manholes may require the use of pipe having a much larger diameter, such as 40 inches or larger. And, these applications may require that the job be completed quickly and efficiently. A need therefore exists for a method and apparatus for trenchless installation of product pipe, which is not labor intensive and allows for man-sized nominal diameter pipes to be jacked to a predetermined line and level. The present invention addresses these problems by employing a pilot-tube guided, auger boring technique that greatly reduces the torque imparted to large diameter pipes and further permits product pipe to be installed concurrently with the expanding member of the pilot-bore methods. As such, the method of the present invention is not limited to the approximately 575 mm. diameter pipe but, instead can be used to install 1000 mm. (40-in.) or larger diameter pipe.

SUMMARY OF THE INVENTION

It is an object of the present invention to provide an apparatus for direct installation of product pipe by pilot-tube guided, auger boring. It is further an object of the present invention to provide an economical method for direct installation of product pipe by pilot tube guided auger boring. It is a further object of the present invention to provide a method and apparatus for practicing the method for direct installation of product pipe by pilot-tube guided, auger boring whereby product pipe may be emplaced underground without the need for trenching the earth between two stations.

In accordance with the purposes of the present invention, as embodied and broadly described herein, the invention comprises an apparatus for trenchless, underground emplacement of product casing between first and second shaft locations. The apparatus comprises a pilot assembly, an intermediate assembly, an enlarging assembly, and a drive assembly. The pilot assembly has a pilot tube segment that includes a leading edge and a trailing edge, and a steering head mounted to the leading edge of the pilot tube segment for operably guiding the pilot tube assembly from the first shaft location to the second shaft location.

The intermediate sleeve assembly of the apparatus comprises an intermediate sleeve segment having a leading edge and a trailing edge, and an intermediate cutting head mountable to the leading edge of the intermediate sleeve segment and to the trailing edge of the pilot tube assembly. The intermediate cutting head has a diameter greater than the diameter of the pilot tube assembly and is operably guided by the pilot tube assembly from the first shaft location to the second shaft location.

The enlarging assembly of the apparatus includes a trailing assembly having a leading edge and a trailing edge and an enlarging cutting head mountable to the leading edge of the trailing assembly and the trailing edge of the intermediate sleeve segment. The enlarging cutting head has a diameter substantially greater than the diameter of the intermediate sleeve assembly. The enlarging assembly is guided by the intermediate cutting head from the first shaft location to the second shaft location.

The drive assembly is configured to advance the pilot assembly, the intermediate assembly, the enlarging assembly and the product pipe from the first shaft location to the second shaft location.

Further in accordance with the present invention, a method for trenchless, underground emplacement of product pipe is disclosed. The method comprises the steps of driving a steerable pilot tube assembly from the first shaft location to the second shaft location, driving an intermediate sleeve assembly having a diameter substantially greater than the diameter of the pilot tube assembly, such that the intermediate sleeve assembly is guided by the pilot tube assembly from the first shaft location to the second shaft location, and driving an enlarging assembly comprising an enlarging cutting head having a diameter substantially larger than the diameter of the intermediate sleeve assembly such that the enlarging assembly is guided by the intermediate sleeve assembly from the first shaft location to the second shaft location. The enlarging assembly includes a trailing assembly having a diameter substantially smaller than the diameter of the enlarging assembly. Finally, the method further includes the step of driving the product pipe from the first shaft location to the second shaft location concurrently with the enlarging assembly.

BRIEF DESCRIPTION OF THE DRAWINGS

The accompanying drawings, which are incorporated in and constitute a part of the specification, illustrate one embodiment of the invention and together with the description, serve to explain the principles of this invention. In the drawings.

DESCRIPTION OF PREFERRED EMBODIMENTS

Reference will now be made in detail to the preferred embodiment of the present invention, an example of which is illustrated in the accompanying figures. Whenever possible, the same reference numbers will be used throughout the description and figures to refer to the same or like parts.

Figure 1:
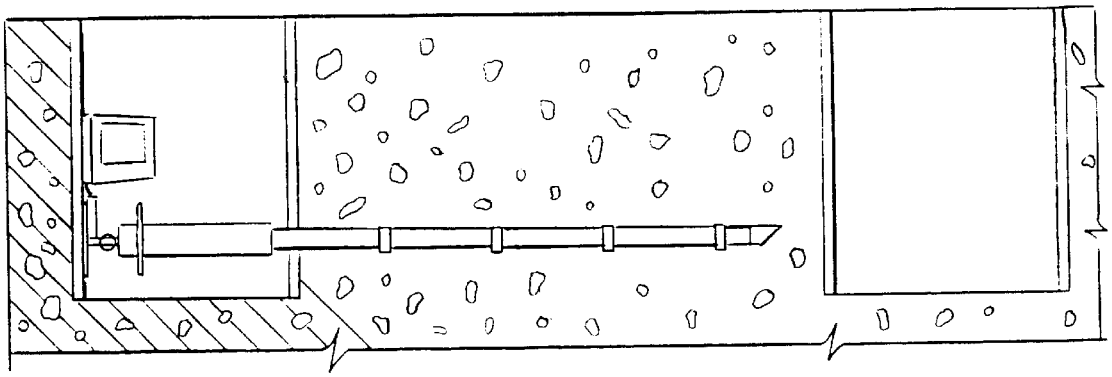
Fig. 1 PRIOR ART
FIG. 1 is a side elevational view of a prior art method for microtunnelling showing a pilot bore being inserted underground.
Figure 2:
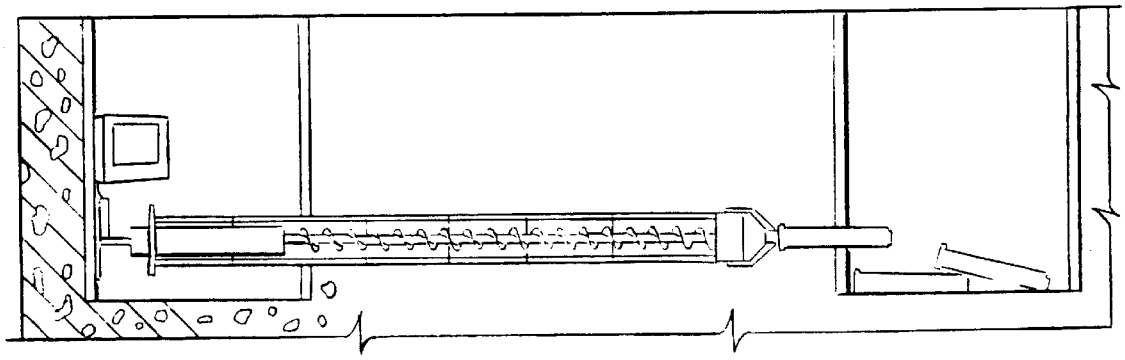
Fig. 2 PRIOR ART
FIG. 2 is a side elevational view of the prior art method for microtunnelling showing the expanding head enlarging the bore.
Figure 3:
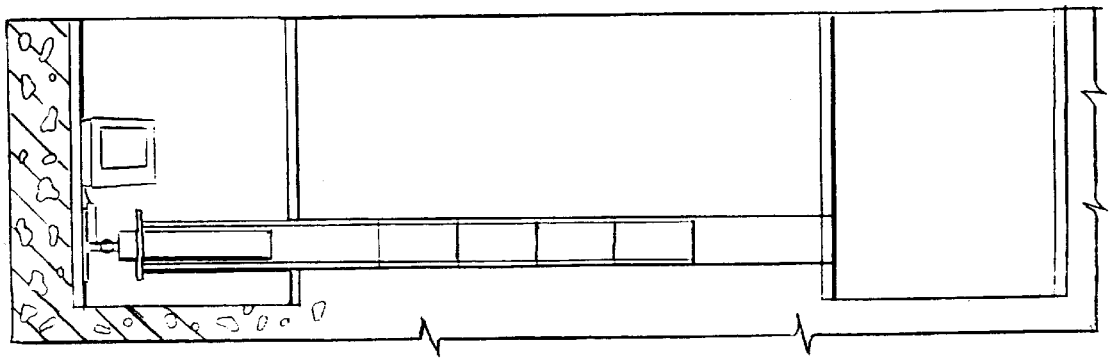
Fig. 3 PRIOR ART
FIG. 3 is a side elevational view of the prior art method for microtunnelling showing the emplacement of product pipe underground.
Figure 4:
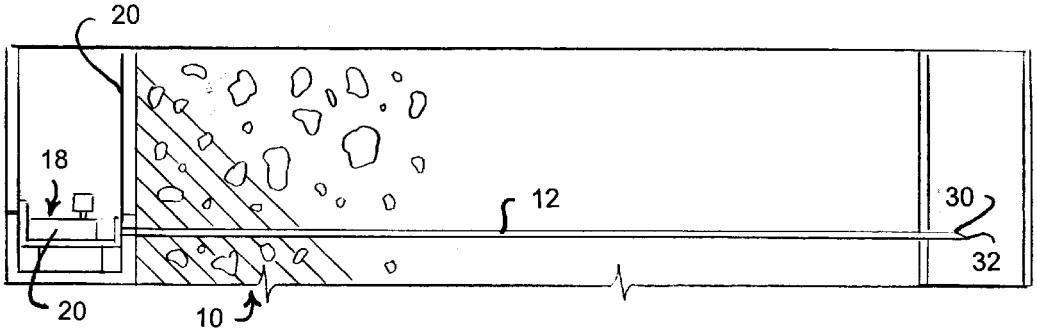
FIG. 4 is a side elevational view of a pilot assembly of the apparatus of the present invention.
Figure 5:
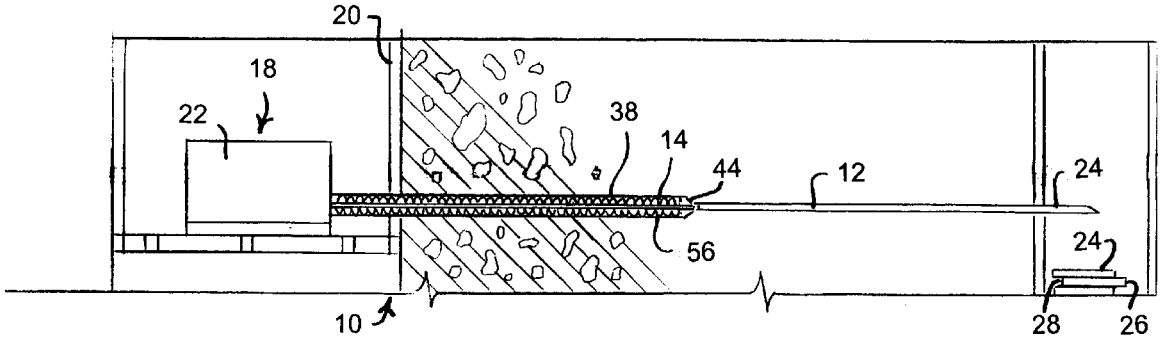
FIG. 5 is a side elevational view of an intermediate assembly of the apparatus of the present invention.
Figure 6:
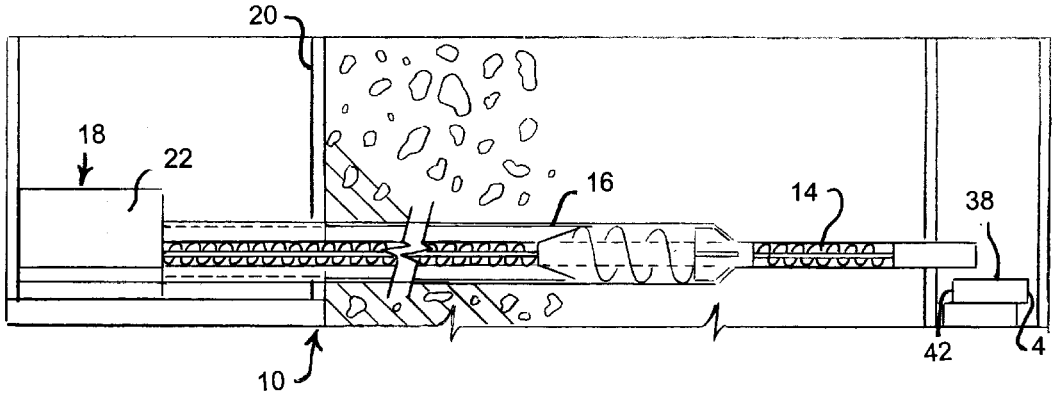
FIG. 6 is a side elevational view of an enlarging assembly of the apparatus of the present invention.

An apparatus for trenchless, underground emplacement of product casing between first and second shaft locations is indicated generally at 10 in FIGS. 4–6. The apparatus 10 comprises a pilot assembly 12, an intermediate assembly 14, an enlarging assembly 16, and a multi-stage drive assembly, indicated generally at 18. The drive assembly 18 is positioned in the first shaft location or drive pit 20 for successively advancing the assemblies into and through the desired underground location and installing product pipe in the remaining bore.

The multi-stage drive assembly 18 includes a microtunneling pipe-driving unit 20, such as the RVS 80 from Soltau Microtunneling Inc. of Charleston, S.C., for advancing the pilot assembly 12 driving from the first shaft location to the second shaft location. This pipe driving unit 20 has a jacking force of 785 kN for jacking product pipe with a maximum outer diameter of 560 mm. The drive assembly 18 further includes an earth boring machine 22, such as Model 48-54-750 from Barbco Inc. of Canton, Ohio. This unit 22 is configured to advance the intermediate assembly 14, the enlarging assembly 16 and the product pipe from the first shaft location to the second shaft location.

The microtunneling drive assembly 20 is secured to the wall opposite the drive side of the pit by means of a back-up wall. This assembly 20 includes a frame that has parallel and equidistant multi-hole rails. The rails are positioned to be parallel to the drive direction and are releasably locked through locking bolts operated by a hydraulically operated locking appliance. The frame can be leveled in its height upon the slab by means of a leveling screws. The blocking of the drive direction is made at a front side of the pit through blocking screws pressing against the pit wall. Preferably, the driving pit and back-up wall have a cylindrical shape. As will be understood by those skilled in the art, the frame of the drive assembly 18 is propped-up with a large portion of its surface on the wall of the drive pit to provide a relatively large bearing area for load distribution.

A thrust bridge slides on the frame between the rails. Pressing units are mounted to this thrust bridge and work in the drive direction. The thrust bridge carries a drive plate pressing directly against product or temporary pipe. The hydraulically operated press pistons are connected to the hydraulically operated locking appliance working at right angles to the drive direction and moving the locking bolts outwards or inwards. It will be understood that the locking bolts may be manually operated instead of hydraulically operated and still be within the scope of the present invention.

To effectuate an advance drive of the pilot pipe driving unit 20, the locking bolts are placed in opposite holes of the frame rails. The pressing units press the thrust bridge forward with respect to the locking appliance by one hole pitch, which is approximately 300 mm. (12 in.). Once this distance has been traveled, the locking bolts are pulled back, and the press pistons are retracted in the drive direction by one hole pitch and the process is repeated until a full pipe length has been driven into the ground.

For example, according to the illustration in FIG. 4, the plate presses the pilot pipe, which in turn presses the steering head thereby compressing the soil at a cutting edge of the pilot pipe. The operation of the microtunneling drive unit is provided for background and is more fully explained in U.S. Pat. No. 4,630,967, which is incorporated herein by reference.

The horizontal earth boring unit 22 of the drive assembly 18 is positioned in a shaft of approximately 10 ft. by 20 ft. dimensions. This unit 22 is similar to the microtunneling unit,except for it is much larger to drive larger pipe and further includes an auger to remove spoil from the pipe being installed.

The pilot assembly 12 includes hollow pilot tube segments, each indicated at 24, in approximately 1 meter increments that are releasably connectable to each other. The pilot tubes 24 include bolted couplings that translate rotation with torque and pull or push forces. Each pilot tube segment 24 has a leading edge 26 and a trailing edge 28 and preferably has an outer diameter of approximately 110 mm. (4½ in.). The pilot assembly 12 further includes a steering head 30, which has a tapered steering tip 32, mounted to the leading edge 26 of the first pilot tube 24. The tip 32, when rotated, provides an accurate and easily controllable steering mechanism.

A battery-powered target plate (not shown) is mounted into the first pilot tube segment and has concentrically arranged LEDs and a reference line to the angle of the steering tip. The target is viewed continuously through the hollow pilot tube assembly 12 by means of a theodolite mounted with a camera on its eye piece. The theodolite transmits a continuous picture of the target on a monitor. The theodolite is set up accurately to the required line and grade for precise installation of the pilot tubes from the drive pit to the target shaft. Thus, any deviation of the pilot tube steering head 30 from the desired course (reference axis) is displayed in the drive pit.

The pilot tube is further configured such that as the first pilot tube segment 24 enters the target or receiving shaft 34, the steering tip 32 may be removed and an attachment (not shown) connected to a lubricant supply can be coupled thereto. This provides augers of the subsequent stages with lubricant to operate. As each pilot tube segment 24 advances such that it is removed in the receiving shaft 34, the attachment is attached to the subsequent pilot sleeve assembly.

The intermediate sleeve assembly 14 of the apparatus 10 comprises at least one intermediate sleeve segment 38 having a leading edge 40 and a trailing edge 42, and an intermediate cutting head 44. This intermediate sleeve assembly 14 has a diameter substantially greater than the diameter of the pilot tube assembly 12. The intermediate sleeve assembly 14 is preferably formed of steel with an outer diameter of approximately 610 mm (24 in.) and a 4 ft. incremental length.

Figure 7:
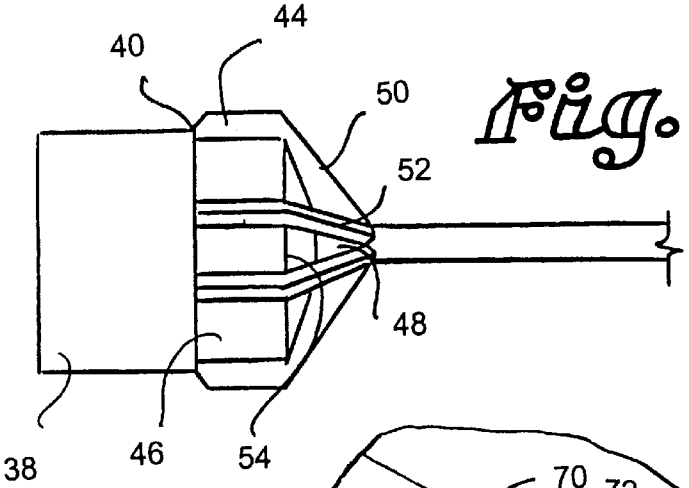
FIG. 7 is a partial side elevation of the intermediate cutting head of the present invention.
Figure 9:
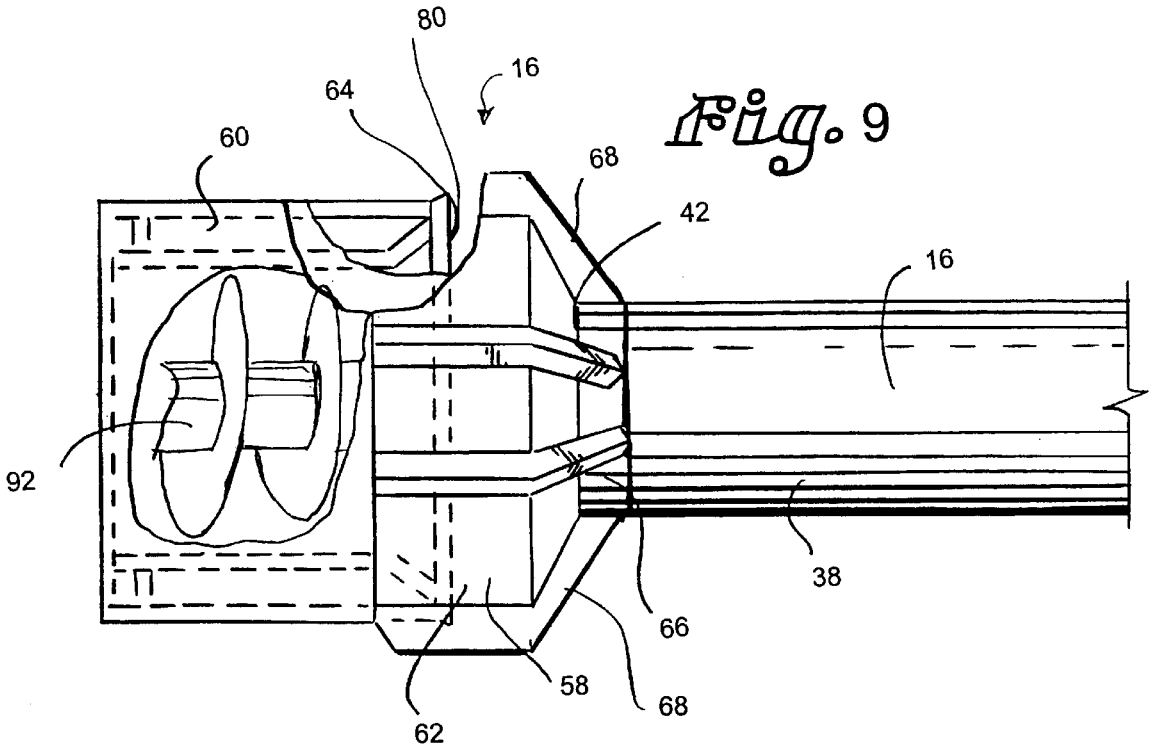
FIG. 9 is a partial elevational view of the enlarging assembly with a portion cut away for clarity.
Figure 10:
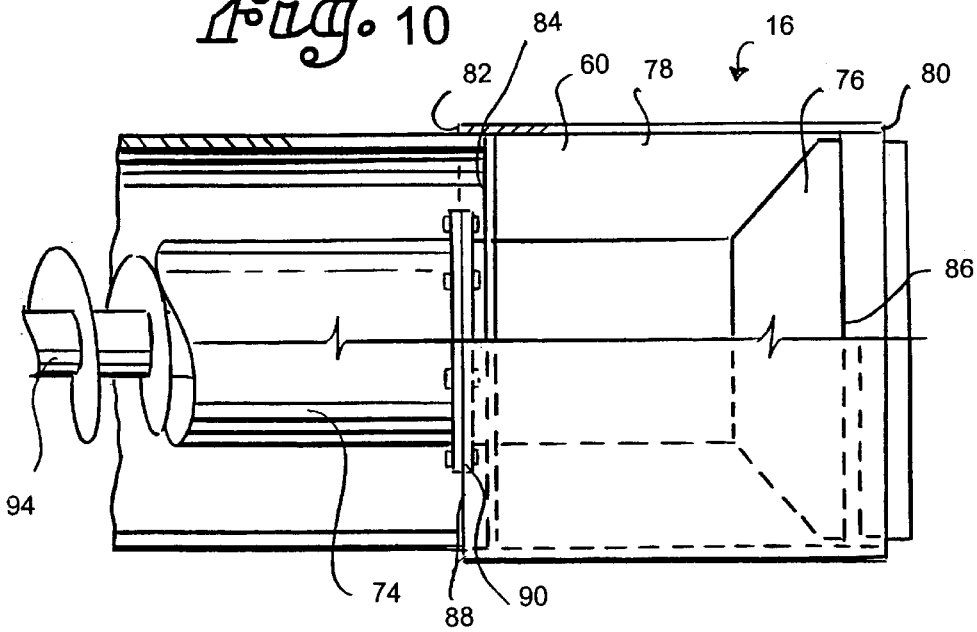
FIG. 10 is a partial elevational view of the adapter casing of the enlargement assembly of the apparatus of the present invention with a portion cut away for clarity.

The intermediate cutting head 44, as shown in FIG. 7, includes a trailing sleeve 46, which may be integral with or securely attached to the leading edge 40 of the first sleeve segment 38, and a leading sleeve 48, which is securely mounted to the last pilot tube segment 24 through bolts or other fastening means. A plurality of cutting fingers 50 extend from the trailing sleeve 46 to the leading sleeve 48 for slashing and thereby loosening the soil as the cutting head 44 is advanced by the drive assembly 18. The fingers 50 are formed to have a relatively sharp leading edge 52, which aids in cutting the soil. Preferably, the trailing sleeve 46 has a raked leading edge 54 and is slightly larger in diameter than the remaining sleeves to overcut the soil as the cutting head 44 is advanced by the drive assembly 18 to reduce the drag on the subsequent sleeve segments 38.

The cutting head 44 is formed from steel with the leading 48 and trailing 38 sleeves being co-axial. With the intermediate cutting head 44 mounted to the pilot tube segment 24, the intermediate sleeve assembly 36 is likewise co-axial with respect to the pilot tube assembly 12. As such, the intermediate assembly 14 is operably guided by the pilot tube assembly 12 from the drive pit 20 to the target shaft 34 through its connection to last pilot tube segment 24. The compacted soil surrounding the pilot tube assembly 12 assists in resisting deflection.

An auger 56 extends within the intermediate sleeve assembly 36 from the earth boring unit 22 of the drive assembly 18 to the intermediate cutting head 44 to remove the soil cut by the intermediate cutting head 44 as it is advanced by the driving unit 22. The auger 56 extends substantially the entire internal diameter of the intermediate assembly 14. Preferably, a 22½ in. auger is employed for a 24 in. diameter intermediate assembly 14.

The enlarging assembly 16 of the apparatus includes an enlarging cutting head 58 or casing and an adapter casing 60. The enlarging cutting head 58 has a diameter substantially larger than the diameter of the intermediate sleeve assembly 14. Preferably, the enlarging cutting head 58 is formed of steel with an outer diameter of approximately 1372 mm. (54 in.) and an incremental length of approximately four ft. It is believed that the enlarging assembly 16 can be as large as approximately 1830 mm. (approx. 72 in.) and still be operable under the teachings of the present invention. The 54 in. dimension used herein is in reference to a 42 in. reinforced concrete pipe with a 52½ in. outer diameter.

The enlarging cutting head 58, as shown in FIG. 7, is similar to the intermediate cutting head 44 except for larger. It includes a trailing sleeve 62, which may be integral with or securely attached to the leading edge 64 of the adapter casing 60, and a leading sleeve 66, which is securely mounted to the trailing end 42 of the last intermediate sleeve segment 38 through bolts or other fastening means. A plurality of cutting fingers 68 extend from the trailing sleeve 62 to the leading sleeve 66 for slashing and thereby loosening the soil as the enlarging cutting head 58 is advanced by the drive assembly 18. The fingers 68 are formed to have a relatively sharp leading edge 70, which aids in cutting the soil. Preferably, the trailing sleeve 62 has a raked leading edge 72 and is slightly larger than the remaining sleeves to overcut the soil as the cutting head is advanced by the drive assembly 18 to reduce the drag on the subsequent sleeve segments or product pipe.

The cutting head 58 is formed from steel with the leading 66 and trailing 62 sleeves being co-axial. With the enlarging cutting head 58 mounted to the intermediate sleeve assembly 36, the sleeves 66, 62 are likewise co-axial with respect to the intermediate assembly's and pilot tube assembly's axis. As such, the enlarging assembly 16 is operably guided by the intermediate sleeve assembly 36 from the drive pit 20 to the target shaft 34 through its connection to last sleeve segment.

The adapter casing 60 comprises an inner casing 74, a transition segment 76, and one drive sleeve segment 78 having a third leading end 80 and a third trailing end 82. The adapter casing 60 is formed of steel and has a length of approximately 4 ft. The drive sleeve 78 of the adapter casing 60 has the same outer diameter as the enlarging casing 16 while the inner casing has an outer diameter in the range of 18" to 24" and preferably 24". Additional inner casing segments 74 are formed of steel in 8 ft. lengths.

The enlarging cutting head 58 is mounted to the third leading edge 80 of the drive sleeve segment 78. The transition segment 76 is frustoconically shaped transitioning from the 54 in. or larger internal diameter drive sleeve to the 24 in. inner casing. An annular wall 84 joins the drive sleeve segment 78 with a trailing edge 82 of the transition casing 76. The trailing edge 82 of the transition casing 76 is provided with a flange 90 for connecting additional segments of the inner casing.

An enlargement casing auger or first auger 92 is provided in the enlarging assembly. Preferably, this auger 92 is sized to extend substantially to the internal diameter of the enlargement casing. This enlargement casing auger 92 only extends from the third leading edge 80 of the drive sleeve segment 78 to the leading edge 86 of the transition segment 76. The auger then tapers downwardly in diameter to match the slope of the transition segment 76. A second auger 94 extends through the inner casing and is attachable to the tapering auger in the transition segment 76. This second auger 94 extends through additional inner casing segments back to the earth boring unit 22 of the drive assembly 18. The second auger 94 likewise extends to substantially the internal diameter of the inner casing and preferably 22½ in. and is releasably connectable to the first auger 92. The combination augers remove the soil cut by the enlarging cutting head 58 as it is advanced by the earth boring unit 22 back to the drive pit.

Concrete, vitrified clay, PVC, fiberglass or other pipe, is driven into the bore created by the enlarging assembly 16 immediately subsequent the drive sleeve 78 of the enlarging assembly 16 through to the target shaft 34. The leading edge 98 of the first product pipe segment abuts the annular wall 84 of the adapter casing 60. As such, the inner casing and the product piper are simultaneously advanced into the bore.

Figure 11:
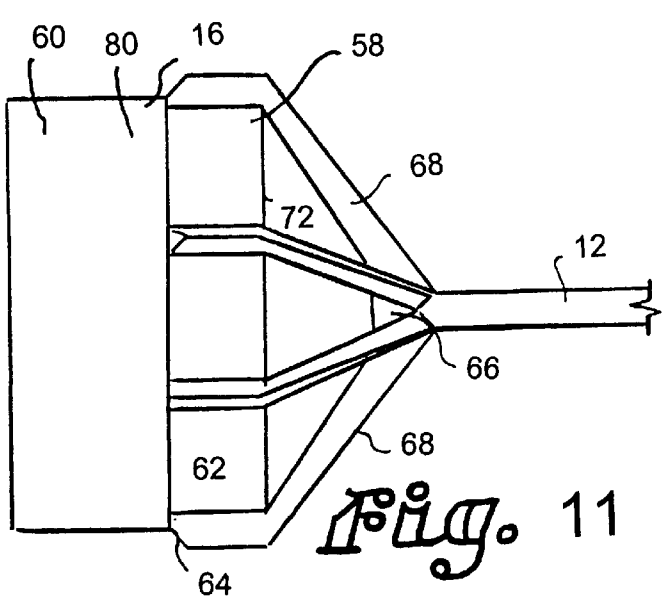
FIG. 11 is an elevational view taken along line 9—9 of FIG. 8 showing an alternative embodiment of the present invention.
Figure 8:
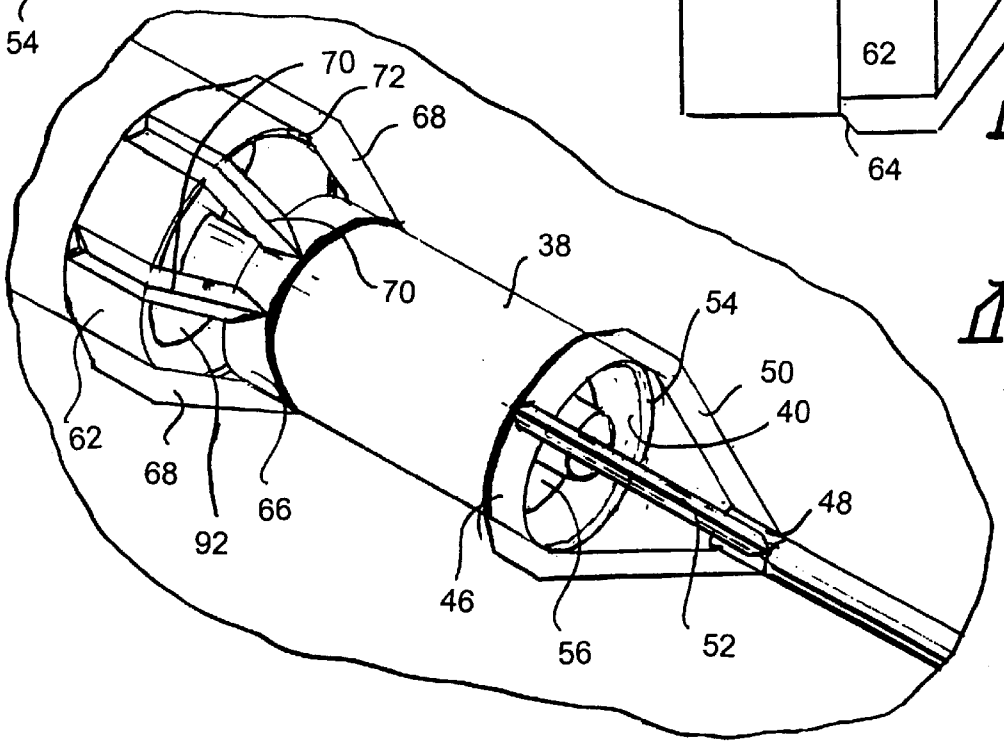
FIG. 8 is a perspective view of the apparatus of the present invention.

An alternative embodiment of the present invention as shown in FIG. 11 is useful for installing product pipe with an outer diameter of approximately 30 in. without requiring an entire temporary casing. The apparatus comprises a pilot assembly 12, an enlarging assembly 16', and a drive assembly (not shown). The pilot assembly 12 and the drive assembly are exactly the same as were described in the first embodiment.

The enlarging assembly 16' of the alternative embodiment is similar to that of the first embodiment. It includes an enlarging cutting head 58' or casing and an adapter casing 60'. The enlarging cutting head 58' has a diameter substantially larger than the diameter of the pilot tube assembly 12. Preferably, the enlarging cutting head 58' of the alternative embodiment has an outer diameter of approximately 30 in. or less and an incremental length of approximately four ft.

The enlarging cutting head 58' of the alternative embodiment includes a trailing sleeve 62', which may be integral with or securely attached to the leading edge 64' of an adapter casing 60', and a leading sleeve 66', which is securely mounted to the trailing end of the last pilot tube segment through bolts or other fastening means. A plurality of cutting fingers 68' extend from the trailing sleeve 62' to the leading sleeve 66' for slashing and thereby loosening the soil as the enlarging cutting head is advanced by the drive assembly 18. The fingers 68' are formed to have a relatively sharp leading edge, which aids in cutting the soil. Preferably, the trailing sleeve 62' has a raked leading edge 72' to overcut the soil as the cutting head is advanced by the drive assembly 18 to reduce the drag on the subsequent sleeve segments.

The cutting head 58' is formed from steel with the leading and trailing sleeves being co-axial. With the enlarging cutting head 58' mounted to the pilot tube assembly, the sleeves are likewise co-axial with respect to the pilot tube assembly's axis. As such, the enlarging assembly 16' is operably guided by the pilot tube assembly 12 from the drive pit 20 to the target shaft 34 through its connection to last pilot tube segment.

The adapter or trailing casing 60' comprises an inner casing, a transition segment, and one drive sleeve segment having a leading end and a trailing end. These components are exactly as the previous embodiment are not shown in the Figures. The adapter casing 60' is formed of steel and has an incremental length of 5 ft. The drive sleeve segment of the adapter casing 60' has the same outer diameter as the enlarging casing while the inner casing has an outer diameter of approximately 24 in. Additional inner casing segments are formed of steel in 8 ft. lengths.

The enlarging cutting head 58' of the alternative embodiment is mounted to the leading edge of the drive sleeve segment. The transition segment is frustoconically shaped transitioning from the 30 in. or larger in diameter drive sleeve to the 24 in. inner casing. An annular wall joins the drive sleeve segment with a leading edge of the transition casing. A trailing edge of the transition casing is provided with a flange for connecting additional segments of the inner casing.

A first or cutting head auger is provided in the enlarging casing of the alternative embodiment. Preferably, the cutting head auger is sized to extend substantially to the internal diameter of the enlargement casing. This auger only extends from the leading edge of the enlarging casing to the leading edge of the transition segment. The auger then tapers downwardly in diameter to match the slope of the transition segment. A second auger extends through the inner casing and is attachable to the tapering auger in the transition segment. This second auger extends through additional inner casing segments back to the drive assembly 18. The second auger likewise extends to substantially the internal diameter of the inner casing and is releasably connectable to the first auger. The combination augers remove the soil cut by the enlarging cutting head as it is advanced by the pipe driving unit 22 back to the drive pit.

Concrete, vitrified clay, PVC, steel or other pipe is driven into the bore created by the enlarging assembly 16' immediately subsequent the drive sleeve of the adapter casing to the target shaft. The leading edge of the first product pipe segment abuts the annular wall of the adapter casing. As such, the inner casing and the product piper are simultaneously advanced into the bore.

In operation, the apparatus 10 and method of the present invention is operated initially as the prior art method for pilot-bore microtunnelling described in the Background of the Invention. A drive pit 20 is constructed through well-known industry techniques. The walls of the drive pit are lined with thrust blocks to withstand the forces exerted by the multi-stage drive assembly 18. The microtunneling unit 20 is hoisted onto the slab of the drive pit and propped up against the back-up wall opposite the drive side of the pit.

The microtunneling unit 20 is then prepared for advancing successive stages of the pilot tube assembly. In the first stage, precision on-target jacking of pilot pipes displaces the soil to create a bore. The pilot pipe is kept on-line through the theodolite fitted with a camera and an illuminated target displayed on a monitor, which is viewed from the jacking shaft. Any deviation from the reference axis is correctable through counter steering of the pilot-pipe assembly. As will be understood by those skilled in the art, any other steering method may be used to steer the pilot tubes of the present invention.

To insure that the drive assembly 18 has been aligned correctly, the position of the jacking axis must be precisely transferred to the drive unit 20 in the drive pit. To achieve this, the jacking axis is determined by means of a theodolite. The theodolite is centered and leveled above a survey point between the drive pit and target shaft. The theodolite is sighted onto the target, marked by a leveling rod. The telescope of the theodolite is transited and sighted onto marks for vertical plumb bobs immediately above the drive pit. The marks are fixed and secured and transmitted to the drive assembly 18.

The first segment of the pilot tube assembly is then advanced into the soil. This segment includes the tapered steering tip. The tip, when rotated, provides an accurate and easily controllable steering mechanism. The battery-powered target plate is mounted into the first pilot tube and has concentrically arranged LEDs and a reference line to the angle of the steering tip. The target is viewed continuously through the hollow pilot tube assembly by means of the theodolite, camera and monitor. The theodolite and camera transmits a continuous picture of the target on a monitor. Any deviation of the pilot tube steering head from the desired course (reference axis) is displayed in the drive pit.

After the pilot pipe has been installed in the length required and has entered the target shaft, the steering tip is removed from the pilot tube segment and a lubricant supply attachment is connected thereto to provide lubrication for the subsequent augers. Further, the microtunneling unit 20 of the drive assembly 18 is replaced by the horizontal earth boring machine. This unit 22 is hoisted on the slab and secured therein as is well-known in the industry.

In the first embodiment of the present invention, the second nonsteered stage widens the bore to a specified diameter by means of an intermediate cutting head. The intermediate cutting head 44 is mounted to the leading edge of the first intermediate sleeve segment 38 and to the trailing edge of the last pilot tube segment. The earth boring machine's auger extends within the intermediate sleeve assembly 36 to remove the soil cut by the cutting head as it is advanced by the earth boring unit 22 back to the drive pit. The auger boring driving unit 22 advances the first steel sleeve and cutting head through the pilot-pipe created bore, with the pilot-pipe assembly serving as guidance to maintain the required line and level. Additional steel sleeves are advanced one behind the other into the drive unit to urge the pilot tube from the newly created bore segment by segment.

Unlike the prior art method of pilot-bore microtunnelling, as the cutting head enters the target shaft, the enlarging assembly 16 is attached by mounting the enlarging cutting head to the trailing end of the last intermediate sleeve segment 38 and to the leading end of the drive sleeve segment 78. The transition casing is mounted to the drive sleeve segment 78 for advancing the drive sleeve segment 78 and enlarging cutting head. The enlarging casing auger is connected to the earth boring unit's auger, which extends through the inner casing of the adapter casing and to the auger of the intermediate assembly 14. The enlarging assembly 16 is then advanced into the bore.

Immediately following this enlarging assembly 16, product pipe is placed into the auger boring drive unit 22 subsequent the drive sleeve of the adapter casing entering the bore and prior to the enlarging cutting head completing the length of the bore to the target shaft. The enlarging assembly 16 and product pipe are jacked concurrently into the bore by placing one segment of product pipe behind the other until the target shaft is reached. Thus, the product pipe is simultaneously advanced into the bore with the enlarging cutting head thereby allowing direct installation of product pipe by pilot tube guided auger boring while not incurring extensive additional labor and time costs.

As such, product pipe is placed in the desired position without disturbing the surface of the earth between the jacking station and target station. The pilot pipe, intermediate sleeve segments and enlarging assembly are recovered segment by segment in the target shaft and ready to use for the next installation.

In the alternative embodiment, after the pilot pipe assembly is installed and the horizontal earth boring machine 22 has replaced the microtunneling unit 20, the enlarging assembly is attached by mounting the enlarging cutting head to the trailing end of the last pilot tube segment and to the leading end of the drive sleeve segment 78.

The transition casing is mounted to the drive sleeve segment 78 for advancing the drive sleeve segment and enlarging cutting head. The enlarging casing auger is connected to the second auger, which extends through the inner casing of the adapter casing to the earth boring unit. The enlarging assembly is then advanced into the bore by the horizontal earth boring unit 22 of the drive assembly 18.

Immediately following this enlarging assembly, product pipe is placed into the drive unit subsequent the drive sleeve of the adapter casing entering the bore and prior to the enlarging cutting head completing the length of the bore to the target shaft. The enlarging assembly and product pipe are jacked concurrently into the bore by placing one segment of product pipe behind the other until the target shaft is reached. Thus, the product pipe is simultaneously advanced into the bore with the enlarging cutting head thereby allowing direct installation of product pipe by pilot tube guided auger boring while not incurring extensive additional labor and time costs.

As such, product pipe is placed in the desired position without disturbing the surface of the earth between the jacking station and target station. The pilot pipe and enlarging assembly are recovered segment by segment in the target shaft and ready to use for the next installation.

Detailed illustrative embodiments of the present invention are disclosed herein. However, the physical configuration of the present invention may be embodied in a wide variety of forms, some of which may be quite different from those of the disclosed embodiments. Consequently, the specific structural and functional details disclosed herein are merely representative; yet in that regard, they are deemed to afford the best embodiment for purposes of disclosure and to provide a basis for the claims herein which define the scope of the present invention.

What is claimed is:

1. An apparatus for trenchless, underground emplacement of product pipe between first and second shaft locations, the apparatus comprising:

a pilot tube assembly comprising at least one pilot tube segment having a first leading end and a first trailing end, and a steering head mounted to the first leading end of the at least one pilot tube segment, the steering head configured to operatively guide the pilot tube assembly from the first shaft location to the second shaft location, an intermediate sleeve assembly having a diameter within a range of 16 to 24½ inches and comprising at least one intermediate sleeve segment having a second leading end and a second trailing end, and an intermediate cutting head mountable to the first trailing end of the pilot tube assembly and to the second leading end of the at least one intermediate sleeve segment, the intermediate cutting head having a diameter substantially greater than the diameter of the pilot tube assembly and configured to be operably guidable by the pilot tube assembly from the first shaft location to the second shaft location, an enlarging assembly comprising at least one drive sleeve segment having a third leading end and a third trailing end, and an enlarging cutting head mountable to the second trailing end of the intermediate sleeve assembly and to the third leading end of the at least one drive sleeve segment, the enlarging cutting head having a diameter in the range of approximately 40 to 60 inches in diameter, the enlarging cutting head and the at least one drive sleeve segment cooperatively configured to be operably guidable by the intermediate sleeve assembly from the first shaft location to the second shaft location, and a drive assembly configured to operably successively advance the pilot tube assembly, the intermediate sleeve assembly, the enlarging assembly, and product pipe from the first shaft location to the second shaft location.

2. The apparatus of claim 1 wherein the drive assembly comprises a microtunneling unit and an earth boring unit.

3. An apparatus for trenchless, underground emplacement of product pipe between first and second shaft locations, the apparatus comprising:

a pilot tube assembly comprising at least one pilot tube segment having a first leading end and a first trailing end, and a steering head mounted to the first leading end of the at least one pilot tube segment, the steering head configured to operatively guide the pilot tube assembly from the first shaft location to the second shaft location, an intermediate sleeve assembly comprising at least one intermediate sleeve segment having a second leading end and a second trailing end, and an intermediate cutting head mountable to the first trailing end of the at least one pilot tube segment and to the second leading end of the at least one intermediate sleeve segment, the intermediate cutting head having a diameter substantially greater than the diameter of the pilot tube assembly and configured to be operably guided by the pilot tube assembly from the first shaft location to the second shaft location, and an enlarging assembly comprising an enlarging casing and an adapter casing, the enlarging casing comprising an enlarging cutting head and a first auger of a first dimension, the adapter casing comprising an inner casing having a second auger of a second dimension, a transition casing transitioning between the inner casing and the enlarging casing, and at least one drive sleeve segment having a third leading end and a third trailing end, the enlarging cutting head being mountable to the second trailing end of the intermediate sleeve segment and to the third leading end of the at least one drive sleeve segment and having a diameter substantially larger than the diameter of the intermediate sleeve assembly and the inner casing of the adapter casing.

4. The apparatus of claim 3 further comprising a drive assembly operably configured to successively advance the pilot tube assembly, the intermediate sleeve assembly, the enlargement assembly, and product pipe from the first shaft location to the second shaft location.

5. The apparatus of claim 4, wherein the inner casing of the adapter casing extends from the drive assembly to the transition casing and operates to advance the enlarging casing from the first shaft location to the second shaft location.

6. The apparatus of claim 4, wherein the drive assembly is configured to operatively simultaneously advance the enlargement assembly and product pipe from the first shaft location to the second shaft location.

7. The apparatus of claim 4, wherein the drive assembly is configured to operatively successively advance the enlargement assembly and product pipe from the first shaft location to the second shaft location.

8. The apparatus of claim 4, wherein the drive assembly comprises a microtunneling unit for advancing the pilot tube assembly from the first shaft location to the second shaft location and an earth boring unit for successively advancing the intermediate sleeve assembly, the enlargement assembly and the product pipe from the first shaft location to the second shaft location.

* * * * *